US010074502B2

(12) United States Patent
Shi et al.

(10) Patent No.: US 10,074,502 B2
(45) Date of Patent: Sep. 11, 2018

(54) OVERLOAD PROTECTION DEVICE AND THERMAL MAGNETIC ADJUSTABLE TRIP UNIT FOR A BREAKER COMPRISING THE SAME

(71) Applicant: Schneider Electric Industries SAS, Rueil-Malmaison (FR)

(72) Inventors: Junchang Shi, Shanghai (CN); Yu Yu, Shanghai (CN); Kunpeng Zhang, Shanghai (CN)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 14/655,915

(22) PCT Filed: Dec. 26, 2013

(86) PCT No.: PCT/CN2013/090573
§ 371 (c)(1),
(2) Date: Jun. 26, 2015

(87) PCT Pub. No.: WO2014/101799
PCT Pub. Date: Jul. 3, 2014

(65) Prior Publication Data
US 2015/0348733 A1 Dec. 3, 2015

(30) Foreign Application Priority Data
Dec. 28, 2012 (CN) ..... 2012 1 0585075

(51) Int. Cl.
*H01H 89/00* (2006.01)
*H01H 50/18* (2006.01)
(Continued)

(52) U.S. Cl.
CPC ..... *H01H 89/00* (2013.01); *H01H 37/52* (2013.01); *H01H 50/18* (2013.01); *H01H 50/36* (2013.01);
(Continued)

(58) Field of Classification Search
CPC ..... H01H 89/00; H01H 37/52; H01H 50/18; H01H 50/36; H01H 71/40; H01H 71/164; H01H 71/16; H01H 71/405; H01H 69/01
(Continued)

(56) References Cited

U.S. PATENT DOCUMENTS 3,081,386 A * 3/1963 Pastene ..... H01H 71/1027 335/159
4,081,852 A * 3/1978 Coley ..... H02H 3/105 335/37
(Continued)

FOREIGN PATENT DOCUMENTS

CN 1337054 A 2/2002
CN 101004987 7/2007
(Continued)

OTHER PUBLICATIONS

International Search Report for International Application No. PCT/CN2013/090573—Date of Completion of Search: Mar. 23, 2014, 3 pages.
(Continued)

*Primary Examiner* — Anatoly Vortman
(74) *Attorney, Agent, or Firm* — Locke Lord LLP

(57) ABSTRACT

An overload protection device is disclosed, characterized in that, the overload protection device comprises a first heating band (i.e., a terminal); a second heating band; a bimetallic strip; a litzendraht wire; a lower part of the first heating band and a lower part of the bimetallic strip are mechanically connected with each other; two ends of the litzendraht wire
(Continued)

mechanically connect with an upper part of the second heating band and an upper part of the bimetallic strip respectively.

9 Claims, 7 Drawing Sheets

(51) Int. Cl.
*H01H 50/36* (2006.01)
*H01H 37/52* (2006.01)
*H01H 71/16* (2006.01)
*H01H 69/01* (2006.01)
*H01H 71/40* (2006.01)

(52) U.S. Cl.
CPC ..... *H01H 71/164* (2013.01); *H01H 69/01* (2013.01); *H01H 71/405* (2013.01)

(58) Field of Classification Search
USPC ..... 337/130
See application file for complete search history.

(56) References Cited

U.S. PATENT DOCUMENTS 4,546,336 A * 10/1985 Petrie ..... H01H 73/18 335/16
4,771,254 A * 9/1988 DiVincenzo ..... H01H 71/43 335/203
5,680,081 A * 10/1997 Scheel ..... H01H 71/2418 218/22
5,831,509 A * 11/1998 Elms ..... H01H 71/125 335/35
6,326,869 B1 * 12/2001 Felden ..... H01H 71/164 335/172
6,515,569 B2 * 2/2003 Lias ..... H01H 71/48 335/35
7,397,333 B2 * 7/2008 Fleege ..... H01H 71/7418 335/35
7,518,482 B2 * 4/2009 Fleege ..... H01H 71/16 337/36
8,026,785 B2 * 9/2011 Tetik ..... H01H 71/16 337/111
9,218,929 B2 * 12/2015 Lehmann ..... H01H 37/52
2010/0164676 A1 7/2010 Jun
2011/0248815 A1 10/2011 Feil et al.

FOREIGN PATENT DOCUMENTS

| | | | |
|---|---|---|---|
| CN | 101371325 | A | 2/2009 |
| CN | 101770906 | A | 7/2010 |
| CN | 101976640 | | 2/2011 |
| CN | 203192722 | U | 9/2013 |
| DE | 3338799 | | 5/1985 |
| EP | 0619591 | | 10/1994 |
| GB | 2228829 | A | 9/1990 |
| SU | 1188803 | A1 | 10/1985 |
| WO | WO0122462 | | 3/2001 |

OTHER PUBLICATIONS

Second Office Action dated Feb. 4, 2016 for Chinese Patent Application No. 201210585075.1, 7 pages.
English Language Translation of Chinese Office Action dated Feb. 4, 2016 for Chinese Patent Application No. 201210585075.1, 7 pages.
Extended European Search Report for European Patent Application No. 13867090.6, dated Jun. 14, 2016, 8 pages.
English Language Translation of International Search Report of International Application No. PCT/CN2013/090573—Date of Completion of Search: Mar. 23, 2014—3 pages.
English Language Translation of International Preliminary Report on Patentability for International Application No. PCT/CN2013/090573—dated Jun. 30, 2015—12 pages.
First Chinese Office Action dated Jun. 3, 2015 for Chinese Patent Application No. 201210585075.1, 8 pages.
English Language Translation of First Chinese Office Action dated Jun. 3, 2015 for Chinese Patent Application No. 201210585075.1, 7 pages.
English Language Machine Translation of Chinese Patent Application Publication No. CN101770906A, Publication Date: Jul. 7, 2010, 6 pages.
English Language Machine Translation of Chinese Patent Application Publication No. CN203192722U, Publication Date: Sep. 11, 2013, 6 pages.
English Language Abstract of Chinese Patent Application Publication No. CN101004987, Publication Date: Jul. 25, 2007, 1 page.
English Language Machine Translation of Chinese Patent Application Publication No. CN101004987, Publication Date: Jul. 25, 2007, 9 pages.
English Language Abstract of Chinese Patent Application Publication No. CN101976640, Publication Date: Feb. 16, 2011, 2 pages.
English Language Machine Translation of Chinese Patent Application Publication No. CN101976640, Publication Date: Feb. 16, 2011, 8 pages.
English Language Machine Translation of European Patent Application Publication No. EP0619591, Publication Date: Oct. 12, 1994, 7 pages.
English Language Abstract of German Patent Application Publication No. DE3338799, Publication Date: May 9, 1985, 1 page.
English Language Machine Translation of German Patent Application Publication No. DE3338799, Publication Date: May 9, 1985, 9 pages.
English Language Abstract of Chinese Patent Application Publication No. CN1337054A, Publication Date: Feb. 20, 2002, 1 page.
English Language Abstract of Chinese Patent Application Publication No. CN101371325A, Publication Date: Feb. 18, 2009, 1 page.
EP Communication for European Patent Application No. 13861090.6 dated Apr. 4, 2018, 5 pages.

* cited by examiner

OVERLOAD PROTECTION DEVICE AND THERMAL MAGNETIC ADJUSTABLE TRIP UNIT FOR A BREAKER COMPRISING THE SAME

This application is a U.S. National Phase filing of International Patent Application No. PCT/CN2013/090573 filed Dec. 26, 2013, which claims priority to Chinese patent application No. CN201210585075.1 filed Dec. 28, 2012, the entire contents of which are incorporated herein by reference.

BACKGROUND

The present disclosure relates to an overload protection device, and particularly relates to an overload protection device applied to a thermal magnetic trip unit for a breaker.

As for the present thermal magnetic trip unit with less rated current (for example, 15 A, 16 A, 20 A etc.), the general problems thereof are lower temperature rising, minor deflection of a bimetallic strip, thus causing unreliable overload protection, that is, it is easy for a late release or a false release to occur. When manufacturing such trip units, they are usually subjected to difficulties of industrialized thermal tuning and a higher rework rate, thereby increasing the manufacturing cost. Furthermore, the massive short-circuit current readily causes damage to the bimetallic strip when it is flowing through the bimetallic strip.

For example, in the present directly-heated trip unit with lower rated current, the rise in temperature of the bimetallic strip in a current loop mainly depends on the heat generated by the bimetallic strip per se. However, such heat output is low due to the limited length of the bimetallic strip, and further, due to the fact that the bimetallic strip is connected to the client terminals directly through an electrically conductive braided wire so that heat dissipation is rapid. The bimetallic strip thus has a lower rise in temperature under a certain current and a minor deflection, its reliability for the overload protection is low and the thermal tuning is difficult. At the same time, the bimetallic strip is easy to be overheated and damaged under the short circuit.

SUMMARY

In order to overcome the above defects in the prior art, the present disclosure provides an overload protection device, and particularly provides an overload protection device applied to a thermal magnetic trip unit of a breaker.

According to one aspect of the present disclosure, an overload protection device is disclosed, characterised in that, the overload protection device comprises a first heating band; a second heating band; a bimetallic strip; an electrically conductive braided wire; a lower part of the first heating band and a lower part of the bimetallic strip are mechanically connected with each other; two ends of the electrically conductive braided wire mechanically connect with an upper part of the second heating band and an upper part of the bimetallic strip respectively.

The mechanical connection of both ends of the electrically conductive braided wire respectively with the upper parts of the first and second heating bands is accomplished by soldering.

The mechanical connection of the lower parts of the first heating band and the bimetallic strip is accomplished by soldering.

Current is flowing through the upper part of the first heating band, the lower part of the first heating band, the lower part of the bimetallic strip, the upper part of the bimetallic strip, the electrically conductive braided wire, the upper part of the second heating band, and the lower part of the second heating band, thus forming an odd-numbered current loop.

According to one aspect of the present disclosure, the first heating band and the second heating band are made from a flat metal band that is bent in a substantial L-shape.

The electrically conductive braided wire is bent in a substantial U-shape. Naturally, the skilled person in this art could bend the electrically conductive braided wire in other shapes, as long as the shape of the bent electrically conductive braided wire can constitute an odd-numbered current loop within an air gap enclosed by a moving armature and a static armature (as described in the following).

According to the present disclosure, there is also provided a thermal magnetic adjustable releaser, which comprises the overload protection device as described above, and further comprises a base, a draft bar, a tripping bar, the static armature, the moving armature and a pivotal shaft.

The overload protection device according to the present disclosure is installed within the thermal magnetic adjustable releaser. The overload protection device, which comprises the first heating band, the bimetallic strip, the electrically conductive braided wire, and the second heating band, is installed in the base of the thermal magnetic adjustable releaser.

The thermal magnetic adjustable trip unit is provided with overload protection and short-circuit protection functions, wherein the overload protection function of the thermal magnetic adjustable trip unit is achieved in a way as follows: with the overload current flowing through and heating the overload protection device, thereby deflecting the bimetallic strip leftwards, the draft bar is pushed to rotate counterclockwise so that the draft bar and the tripping bar move and release with respect to each other and, the tripping bar release occurs and also causes the break body to release and thus cut off the overload current. The short-circuit protection function of the thermal magnetic adjustable trip unit is achieved in a way as follows: with the short-circuit current flowing through the overload protection device, a magnetic field occurs in the air gap enclosed by the static armature and the moving armature (the magnetic fields created by the currents flowing in inversed directions counteract with each other, thus it is required to have the current loop for uneven times in this area, as for the present disclosure, the number of the current loops between the moving and static armatures is 3), and attractive force is created between the static armature and the moving armature, thereby the moving armature rotates clockwise around the pivotal shaft and pushes the draft bar to rotate counterclockwise, the tripping bar release occurs and causes the breaker body to release and thus cut off the short-circuit current.

According to the present disclosure, a breaker comprising the thermal magnetic adjustable trip unit as mentioned above is also provided.

In the overload protection device disclosed in the present disclosure, the new second heating band is added into the circuit loop and is also connected to the bimetallic strip through the electrically conductive braided wire, the bimetallic strip and the first heating band (also known as: terminal) are connected with each other, such that the length of the current loop is far longer than that in the existing product. In this way, the current loop in the trip unit comprises the first heating band, the bimetallic strip, the electrically conductive braided wire and the second heating band, and the length and resistance value added into the circuit loop is dramatically increased when compared with the existing product, thereby the rise in temperature and the deflection amount occurs for the bimetallic strip of the trip unit with lower rated current is also dramatically increased, and provides a more reliable overload protection function and a much easier industrialized thermal tuning and reduced manufacturing cost. Through selection of materials for the second heating band, the bimetallic strip, and the first heating band, it is possible to optimize the temperature rising distribution along the whole circuit, so that, when the bimetallic strip has a higher temperature rising, the terminal and the breaker body would have a lower temperature rising (meet the standard requirements), thus increasing the design margin for the temperature rising of the breaker. At the same time, due to the increase of circuit impedance, it is possible to restrict the short-circuit current more effectively and also protect the whole circuit loop comprising the bimetallic strip, while being more conducive to the realization of breaking.

Simulation and experiment have proven that the current loop of this configuration causes a clearly improved deflection of the bimetallic strip than that of the existing product. The thermal tuning for the existing product is set to be 0.7 mm, the thermal tuning provided by this novel configuration can be set to be about 2.5 mm, and an area between the regulated non-release curve and the regulated release curve is broadened by 3 times, thus the thermal tuning is easier to achieve and the reliability of overload protection is greatly improved.

So far, in order that the detailed description of the present disclosure can be better understood, and also in order that the contribution of the present disclosure to the prior art can be best recognized, the present disclosure has summarized the embodiments of the present disclosure quite extensively. Of course, the embodiments of the present disclosure will be described in the following, and will set forth the subject matter of the attached claims.

Before explaining the embodiment of the present disclosure in detail, it should be understood that the present disclosure is not restricted to the details of structure and configuration of the components and equivalent steps set out in the following description or illustrated in the drawings. The present disclosure can comprise embodiments other than the described ones, and can be embodied and carried out in different manners. Moreover, it should be appreciated that the wording and terminology and summary used herein are merely for descriptive purposes, and should not be construed as being restrictive.

Likewise, the skilled person in this art would recognize that the technical conception on which the present disclosure is based may be readily used for the basis for designing other configurations, and may be used to implement several purposes of the present disclosure. Hence, it is important that the attached claims should be considered as encompassing such equivalent structures, so long as they do not go beyond the essence and scope of the present disclosure.

BRIEF DESCRIPTION OF THE DRAWINGS

The following drawings will provide a better understanding of the present disclosure for the skilled person in this art, and will present the advantages of the present disclosure even more clearly. The drawings described herein are merely used for the purpose of describing the selected embodiments, rather than all of the possible embodiments, and are not intended to limit the scope of the present disclosure.

DETAILED DESCRIPTION

In the following, a detailed description will be made to preferred embodiments according to the present disclosure in conjunction with the attached drawings. Based on the drawings and corresponding description, the skilled person in this art will comprehend the features and advantages of the present disclosure.

Figure 1:
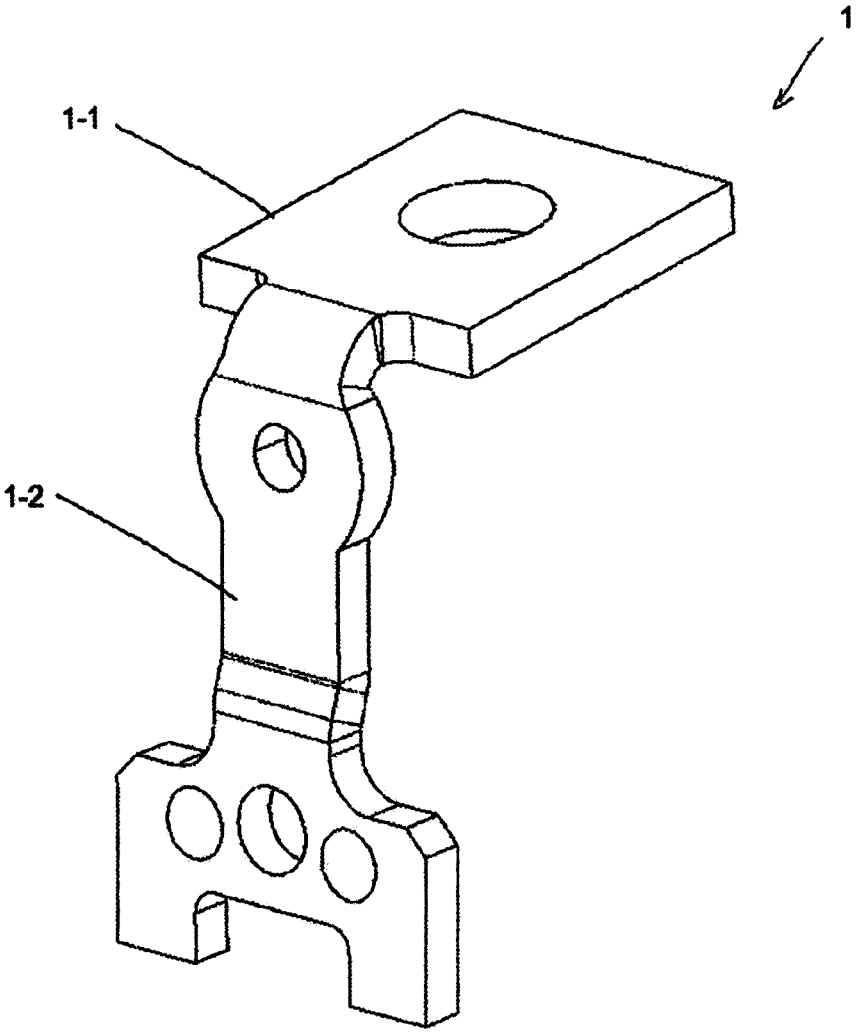
FIG. 1 illustrates a first heating band according to the present disclosure.

FIG. 1 illustrates a first heating band 1 according to the present disclosure, wherein the first heating band 1 comprises an upper part 1-1 of the first heating band and a lower part 1-2 of the first heating band, and the first heating band is made from a flat metal band that is bent in a substantial L-shape.

Figure 2:
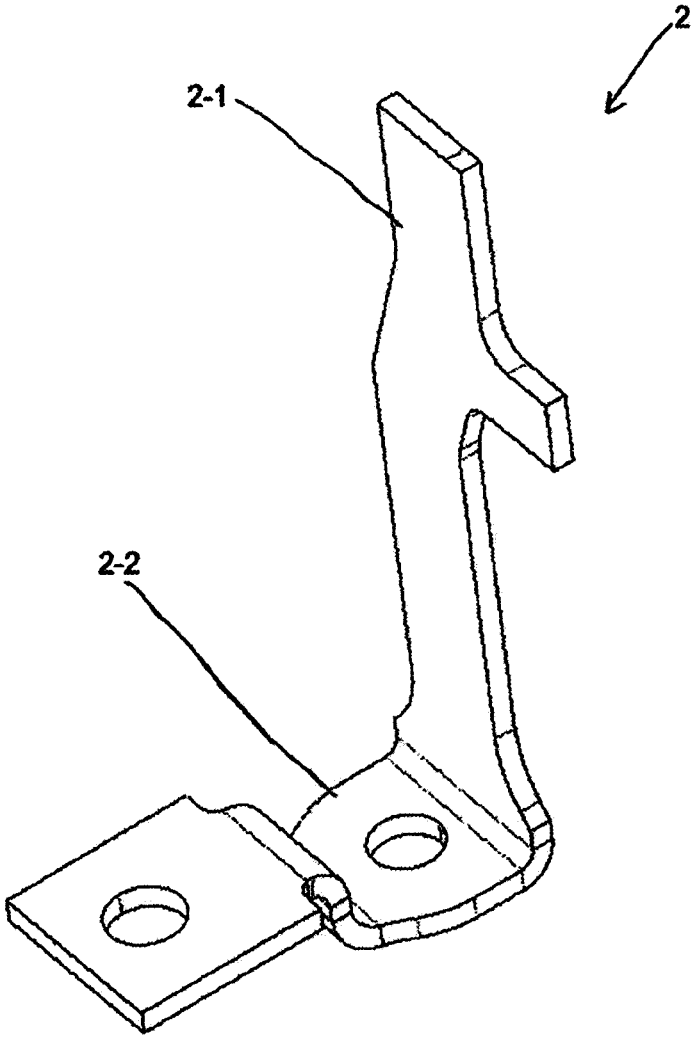
FIG. 2 illustrates a second heating band according to the present disclosure.
Figure 3:
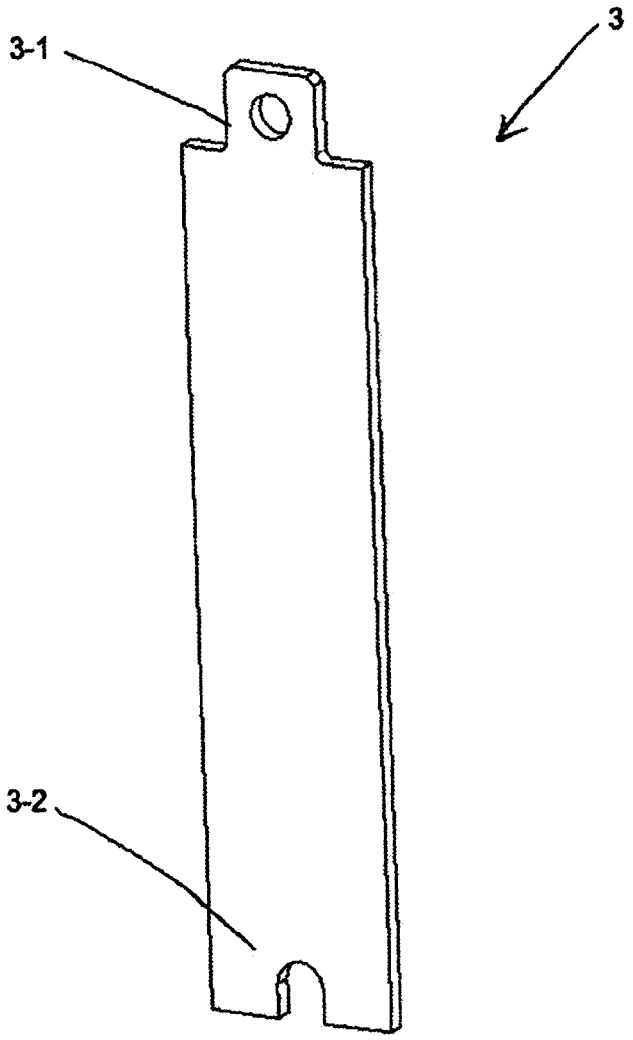
FIG. 3 illustrates a bimetallic strip according to the present disclosure.
Figure 4:
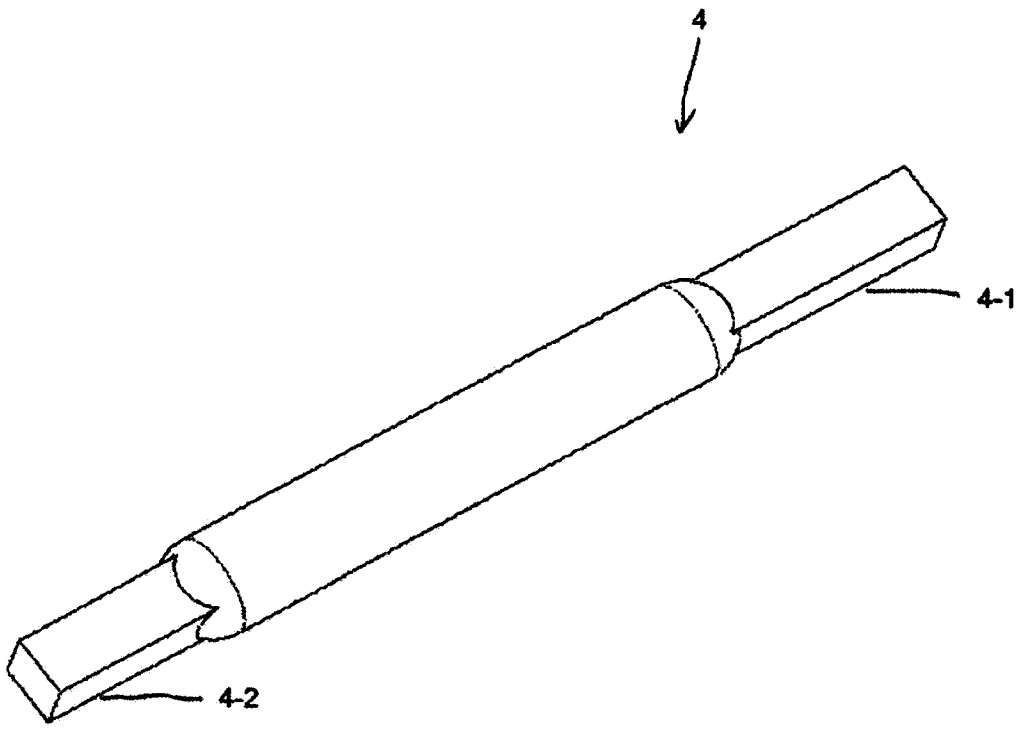
FIG. 4 illustrates an electrically conductive braided wire according to the present disclosure.

FIG. 2 illustrates a second heating band 2 according to the present disclosure, wherein the second heating band 2 comprises an upper part 2-1 of the second heating band and a lower part 2-2 of the second heating band, and the second heating band is made from a flat metal band that is bent in a substantial L-shape. FIG. 3 illustrates a bimetallic strip 3 according to the present disclosure, the bimetallic strip 3 comprises an upper part 3-1 of the bimetallic strip and a lower part 3-2 of the bimetallic strip. FIG. 4 illustrates an electrically conductive braided wire 4 according to the present disclosure, the electrically conductive braided wire 4 comprises two ends 4-1 and 4-2.

FIG. 3 illustrates a bimetallic strip 3 according to the present disclosure, the bimetallic strip 3 comprises an upper part 3-1 of the bimetallic strip and a lower part 3-2 of the bimetallic strip.

FIG. 4 illustrates an electrically conductive braided wire 4 according to the present disclosure, the electrically conductive braided wire 4 comprises two ends 4-1 and 4-2.

Figure 5:
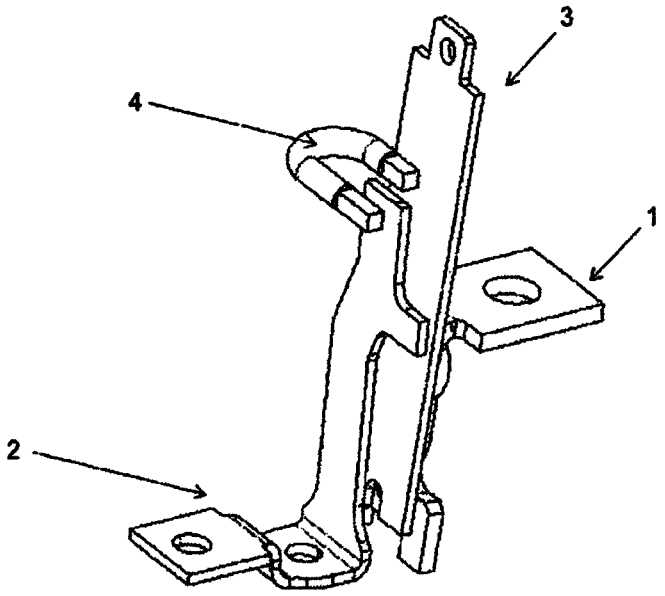
FIG. 5 illustrates the assembly view of the overload protection device comprising the first heating band, the second heating band, the bimetallic strip and the electrically conductive braided wire according to the present disclosure.

FIG. 5 shows an assembly view of the overload protection device according to the present disclosure comprising the first heating band 1, the second heating band 2, the bimetallic strip 3 and the electrically conductive braided wire 4, wherein the lower part of the first heating band 1 is mechanically connected with the lower part of the bimetallic strip 3; the two ends 4-1 and 4-2 of the electrically conductive braided wire 4 are mechanically connected with the upper parts of the second heating band 2 and the bimetallic strip 3 respectively.

The mechanical connection of both ends 4-1 and 4-2 of the electrically conductive braided wire 4 respectively with the upper parts of the second heating band 2 and the bimetallic strip 3 is accomplished by soldering.

The mechanical connection of the lower parts of the first heating band 1 and the bimetallic strip 3 is accomplished by soldering.

Figure 6:
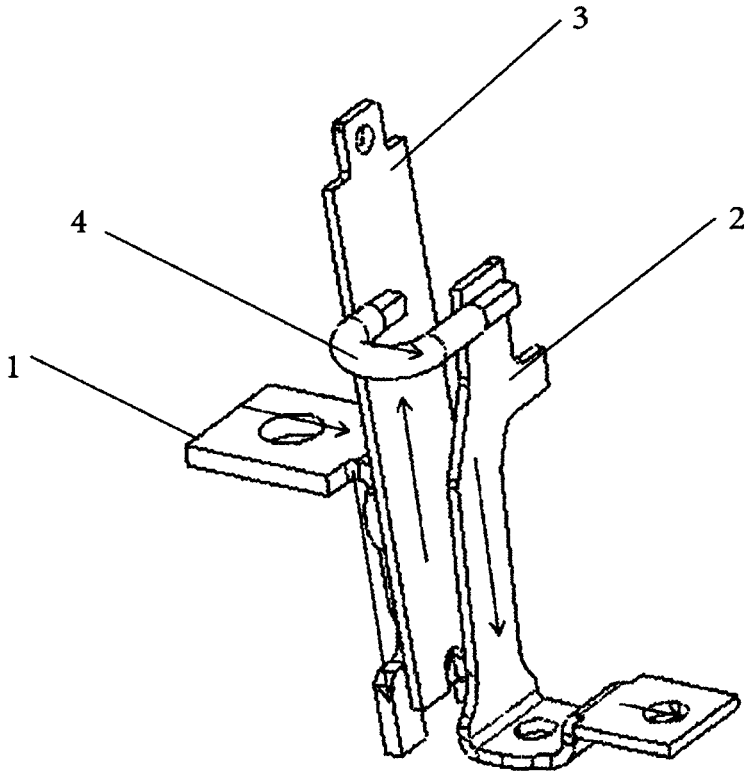
FIG. 6 illustrates a current circuit including the first heating band, the bimetallic strip, the electrically conductive braided wire and the second heating band.

FIG. 6 illustrates a current (circuit) loop comprising the first heating band 1, the bimetallic strip 3, the electrically conductive braided wire 4 and the second heating band 2, wherein the current flows through in order of the upper part 1-1 of the first heating band 1, the lower part 1-2 of the first heating band 1, the lower part 3-2 of the bimetallic strip 3, the upper part 3-1 of the bimetallic strip 3, the electrically conductive braided wire 4, the upper part 2-1 of the second heating band 2 and the lower part 2-2 of the second heating band 2 in a direction of an arrow successively, thereby forming an odd-numbered current loop.

As shown in FIG. 5, the electrically conductive braided wire 4 is bent in a substantial U-shape. Naturally, the skilled person in this art could bend the electrically conductive braided wire into other shapes, as long as the shape of the bent electrically conductive braided wire can constitute the odd-numbered current loop within an air gap 5-7 enclosed between a moving armature and a static armature.

According to the present disclosure, a thermal magnetic adjustable trip unit comprising the overload protection device as mentioned above is also provided.

Figure 7:
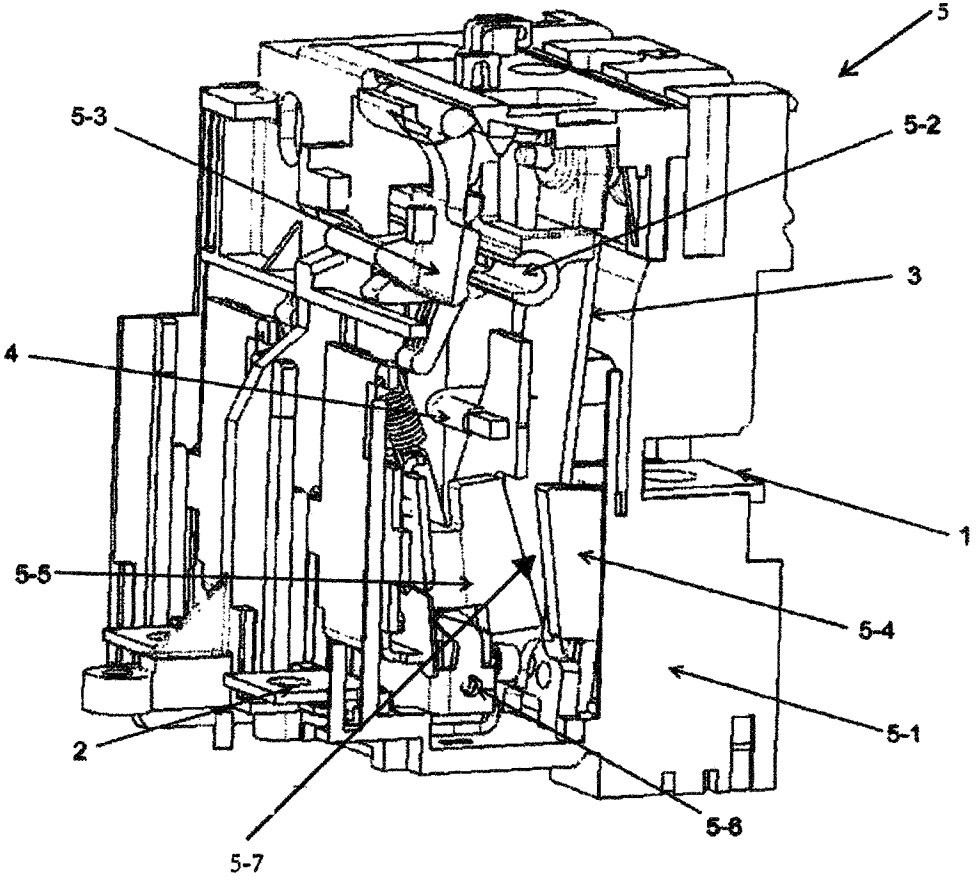
FIG. 7 illustrates a perspective view of the thermal magnetic adjustable trip unit which comprises the overload protection device of FIG. 5.

As shown in FIG. 7, the present disclosure provides a thermal magnetic adjustable trip unit 5 comprising the overload protection device as shown in FIG. 5, and furthing comprising a base 5-1, a draft bar 5-2, a tripping bar 5-3, the static armature 5-4, the moving armature 5-5 and a pivotal shaft 5-6.

FIG. 7 illustrates the installation and operation principle of the overload protection device according to the present disclosure within the thermal magnetic adjustable trip unit 5. The overload protection device, which comprises the first heating band 1, the bimetallic strip 3, the electrically conductive braided wire 4, and the second heating band 2, is installed in the base 5-1 of the thermal magnetic adjustable trip unit 5.

The thermal magnetic adjustable trip unit is provided with overload protection and short-circuit protection functions, wherein the overload protection function of the thermal magnetic adjustable trip unit is achieved in a way as follows: with the overload current flowing through and heating the overload protection device, thereby deflecting the bimetallic strip 3 leftwards, the draft bar 5-2 is pushed to rotate counterclockwise so that the draft bar 5-2 and the tripping bar 5-3 move and release with respect to each other and, the tripping bar 5-3 occurs release and also causes the breaker body to release and cut off the overload current. The short-circuit protection function of the thermal magnetic adjustable trip unit is achieved in a way as follows: with the short-circuit current flowing through the overload protection device, a magnetic field occurs in the air gap 5-7 enclosed by the static armature 5-4 and the moving armature 5-5 (the magnetic fields created by the currents flowing in inversed directions counteract with each other, thus it is required to have odd-numbered current loops in this area, as for the present disclosure, the numbers of current loop between the moving and static armatures are 3), and attractive force is created between the static armature 5-4 and the moving armature 5-5, thereby the moving armature rotates clockwise around the pivotal shaft 5-6 and pushes the draft bar 5-2 to rotate counterclockwise, tripping bar 5-3 then occurs release and causes the breaker body to release and thus cut off the short-circuit current.

According to the present disclosure, a breaker comprising the thermal magnetic adjustable trip unit as mentioned above is also provided.

In this current loop of the new trip unit designed according to the present disclosure, the current loop comprises the first heating band 1, the bimetallic strip 3, the electrically conductive braided wire 4 and the second heating band 2. Compared with the existing product, the length and the resistance value of the circuit loop according to the present disclosure is dramatically increased, thereby the rise in temperature and deflection amount occurring for the bimetallic strip of the trip unit with a lower rated current is also dramatically increased. This design provides a more reliable overload protection function and a much easier thermal tuning and reduces the manufacturing cost. Through selection of materials for the second heating band, the bimetallic strip, and the first heating band, it is possible to optimize the temperature rising distribution along the whole circuit loop, so that when the bimetallic strip has a higher temperature rising, the terminal and the breaker body will have a lower temperature rising (meet the standard requirements), thus increasing the design margin for the temperature rising of the breaker. At the same time, due to the increase of circuit impedance, it is possible to restrict the short-circuit current more effectively and also protect the whole circuit loop comprising the bimetallic strip while being more conducive to the realization of breaking.

Simulation and experiment have proven that the current loop based on this configuration causes a clearly improved deflection of the bimetallic strip than that of the existing product. The thermal tuning for the existing product is set to be 0.7 mm, the thermal tuning provided by this novel configuration can be set to be about 2.5 mm, and an area between the regulated non-release curve and the regulated release curve is broadened by 3 times, thus the thermal tuning is easier to achieve and the reliability of overload protection is greatly improved.

Referring to the specific embodiments, although the present disclosure has already been described in the Description and the drawings, it should be appreciated that the skilled person in this art could make various alterations and various equivalent matter could substitute for the method steps and detection means therein without departing from the scope of the present disclosure defined by the attached claims. Furthermore, the combination and mating among the technical features, elements and/or functions of the specific embodiments herein is clear. Thus, according to the present disclosure, the skilled person in this art will appreciate that the technical features, elements and/or functions in these embodiments may be combined into another specific embodiment as required, unless the aforesaid contents are described otherwise. Moreover, according to the teaching of the present disclosure, many modifications may be made so as to adapt to special situations without departing from the essential scope of the present disclosure. Therefore, the present disclosure is not limited to individual specific embodiments illustrated in the drawings, and specific embodiments described as the optimal embodiments proposed for conducting the present disclosure in the Description. Instead the present disclosure intends to encompass all the embodiments that fall within the scope of the Description and the attached claims.

What is claimed is:

1. An overload protection device, comprising:

a first heating band;

a second heating band;

a bimetallic strip; and an electrically conductive braided wire, wherein the first and second heating bands are made entirely from a flat metal band being bent substantially in an L-shape, wherein a lower part of the first heating band is mechanically connected with a lower part of the bimetallic strip, wherein two ends of the electrically conductive braided wire are mechanically connected with an upper part of the second heating band and an upper part of the bimetallic strip respectively, wherein the overload protection device is configured for current flow in a direction in a successive order of an upper part of the first heating band, the lower part of the first heating band, the lower part of the bimetallic strip, the upper part of the bimetallic strip, the electrically conductive braided wire, the upper part of the second heating band, and the lower part of the second heating band, thus forming an odd-numbered current loop, and wherein current flow through the first heating band and current flow through the bimetallic strip are in opposite directions relative to one another in portions of the first heating band and the bimetallic strip that directly overlap one another.

2. The overload protection device according to claim 1, wherein the two ends of the electrically conductive braided wire are soldered with the upper parts of the bimetallic strip and the second heating band, respectively, to form mechanical connections.

3. The overload protection device according to claim 1, wherein a the lower parts of the first heating band and the bimetallic strip are soldered together to form a mechanical connection.

4. The overload protection device according to claim 1, wherein the electrically conductive braided wire is bent substantially in a U-shape.

5. A thermal magnetic adjustable trip unit, comprising an overload protection device according to claim 1, and further comprising a base, a draft bar, a tripping bar, a static armature, a moving armature and a pivotal shaft.

6. The thermal magnetic adjustable trip unit according to claim 5, wherein when an overload current is flowing through and heating the overload protection device, the bimetallic strip is deflected, the draft bar is pushed to rotate so that the draft bar and the tripping bar move and release with respect to each other, and the tripping bar releases.

7. The thermal magnetic adjustable trip unit according to claim 6, wherein when a short-circuit current is flowing through the overload protection device, a magnetic field occurs in an air gap enclosed by the static armature and the moving armature, and attractive force is formed between the static armature and the moving armature, thereby the moving armature rotates clockwise around the pivotal shaft and pushes the draft bar to rotate counterclockwise, and the tripping bar releases.

8. The thermal magnetic adjustable trip unit according to claim 7, wherein the number of the current loops between the static armature and the moving armature is odd.

9. A breaker, the breaker comprising the thermal magnetic adjustable trip unit according to claim 5.

* * * * *